US005804136A

United States Patent [19]

Kagan

[11] Patent Number: 5,804,136

[45] Date of Patent: Sep. 8, 1998

[54] RADIAL-FLOW DISTRIBUTOR FOR WIDE UNIFORM NONTURBULENT NON-DRIBBLING POURING OF MOLTEN METAL INTO A CONTINUOUS METAL-CASTING MACHINE-METHODS AND APPARATUS

[75] Inventor: Valery G. Kagan, Colchester, Vt.

[73] Assignee: Hazelett Strip-Casting Corporation, Colchester, Vt.

[21] Appl. No.: 756,377

[22] Filed: Nov. 27, 1996

[51] Int. Cl.[6] ..... B22D 11/00

[52] U.S. Cl. ..... 266/230; 222/594; 164/479

[58] Field of Search ..... 266/230, 227; 222/594; 164/479, 439, 335, 337

[56] References Cited

U.S. PATENT DOCUMENTS

| | | | |
|---|---|---|---|
| 4,588,021 | 5/1986 | Bergeron et al. | 164/432 |
| 4,674,558 | 6/1987 | Hazelett et al. | 164/481 |
| 4,712,602 | 12/1987 | Kaiser et al. | 164/453 |
| 4,828,012 | 5/1989 | Honeycutt, III et al. | 164/479 |
| 4,896,715 | 1/1990 | Honeycutt | 164/479 |
| 4,940,077 | 7/1990 | Honeycutt, III et al. | 164/463 |
| 4,949,776 | 8/1990 | Takasugi | 164/437 |
| 5,238,049 | 8/1993 | Martin | 222/594 |
| 5,251,686 | 10/1993 | Key | 164/479 |

*Primary Examiner*—Scott Kastler

*Attorney, Agent, or Firm*—G. Kendall Parmelee; Parmelee & Bollinger, LLP

[57] ABSTRACT

A radial-flow, wide-pouring molten-metal distributor comprising a curved or arcuate overflow weir which is normally horizontal on its top and which is concave on its upstream side as viewed from above. Over this arc-shaped overflow weir flows molten metal to be continuously cast in an open pool. An impetus is thereby imparted to the molten metal along diverging radial lines. The flow so impelled continues radially onto a horizontal apron. The flow spreads fanwise to the desired width which may be as much as six times the width of the weir. Thence, the metal cascades or flows uniformly into the casting apparatus. The overflow weir is preferably supplemented by a skimmer mounted above it in substantially uniform spaced aligned relationship, thereby completing a slot beneath the skimmer through which the molten metal flows. When employed for the casting of wide, thin product, the invention results in a far more uniform and gentle distribution of metal than heretofore available. Dribbling and "beards" are eliminated. Swirls and porosity are reduced. The temperature profile across the section being cast is rendered more uniform, thereby permitting a lower temperature of the supply of molten metal entering this novel distributor.

22 Claims, 7 Drawing Sheets

RADIAL-FLOW DISTRIBUTOR FOR WIDE UNIFORM NONTURBULENT NON-DRIBBLING POURING OF MOLTEN METAL INTO A CONTINUOUS METAL-CASTING MACHINE-METHODS AND APPARATUS

U. S. PATENT DOCUMENTS

| | | | |
|---|---|---|---|
| 4,588,021 | 5/1986 | Bergeron et al. | 164/432 |
| 4,674,558 | 6/1987 | Hazelett et al. | 164/481 |
| 4,828,012 | 5/1989 | Honeycutt et al. | 164/479 |
| 4,896,715 | 1/1990 | Honeycutt | 164/479 |

BACKGROUND

In the continuous casting of metal, an initially narrow flow of molten metal from a launder conveys molten metal from the furnace to the distributor or tundish which distributes metal into the continuous casting machine. The launder is usually narrow in order to conserve heat and prevent oxidation of the metal, especially metals of relatively high melting point such as copper or steel. In order to cast a relatively thin section of metal at least about 300 millimeters (about 12 inches) wide in a continuous casting machine, the metal must usually become spread out, must usually become a wider flow by the time it enters the casting machine. In the continuous casting of such sections by the method of open-pool pouring, persistent problems include that of supplying a proportioned flow of molten metal across the full casting width. There is desired to obtain a flow of uniform, minimally-turbulent, equally-hot but not unnecessarily-hot molten metal into the full width of the continuous casting machine, while at the same time it is desired to prevent prematurely freezing dribbles or "beards" which, when they finally break loose, cause a fissured product or jam the casting machine. Open-pool pouring is described in U.S. Pat. No. 4,712,602 by Kaiser et al., assigned to the assignee of the present invention.

Honeycutt et al. in U.S. Pat. Nos. 4,828,012 and 4,896,715 disclosed a molten-metal-feeding tundish or distributor which was fed molten metal from a launder, a narrow channel. Honeycutt's distributor comprised one or more baffles to divert and spread a flow of molten metal out to an increased width of flow which was deposited near the top of the lower of a pair of horizontally-disposed rolls of a twin-roll casting machine from which the cast product emerged nearly horizontal. Honeycutt had the primary purpose of maintaining a non-uniform higher temperature of the molten metal at the edges of the flow than at the middle. The methods and apparatus of Honeycutt did not solve the problems discussed above.

SUMMARY

The above problems in the open-pool pouring of molten metal in a wide continuous casting machine are essentially solved or substantially overcome by means of a novel distributor to distribute molten metal by using principles heretofore not used in the continuous casting of metals. This novel distributor comprises a weir of concave shape on its upstream side as seen in a plan view from above. An initially deep, slowly flowing metal supply from upstream converges upon and passes over or through this weir as a shallow stream. The decrease in the depth of the stream causes the flow to speed up. This increase in flow speed as the metal traverses the weir naturally occurs in localized vector directions which are perpendicular to the weir at each localized point across the width of the arcuate weir. Hence the flow of molten metal is spread out fanwise. This fanwise flow of molten metal is introduced directly onto an approximately horizontal fan-shaped shelf or apron. The flow spreads fanwise on the apron in a calm, orderly manner to the desired full width at the downstream edge of the apron, at which point the flow of metal flows uniformly down into the casting machine. The invention is notably relevant to belt-type casting machines.

By virtue of providing more uniform temperature distribution across the full width of the resultant fanned-out flow, the temperature of incoming molten metal in the supply runner may advantageously be cooler than used in prior-art feeding of wide continuous casting machines, because reliable temperature uniformity avoids likelihood of occurrences of undesired premature localized frozen regions in the in-feed operation.

BRIEF DESCRIPTION OF THE DRAWINGS

Other objects, aspects, features and advantages of the present invention will be apparent from the following detailed description of the presently preferred embodiments considered in conjunction with the accompanying drawings, which are presented as illustrative and are not intended to limit the invention. In particular, the specification will proceed primarily in terms of a twin-belt casting machine. Corresponding reference numbers are used to indicate like components or elements throughout the various Figures. Large outlined arrows point "downstream", indicating the direction of molten-metal or product flow from the launder to its exit from the continuous casting machine as the frozen product. "Upstream" is the opposite direction.

DESCRIPTION OF THE MOST PREFERRED EMBODIMENT

The present invention may for example be used to advantage in connection with a wide belt-type continuous casting machine 10 (FIG. 1) which utilizes one or more wide endless flexible metallic belts as the main wall or walls of the mold. Such a casting belt is moving, endless, thin, flexible, metallic, and water-cooled. The elements of the belt successively enter and leave a wide moving mold while moving therein in the direction of product flow. By way of illustration, the invention will be described in terms of its use with a twin-belt continuous metal-casting machine 10. Such a machine is described in patents such as U.S. Pat. No. 4,674,558 of Hazelett et al. or U.S. Pat. No. 4,588,021 of Bergeron et al., which are assigned to the assignee of the present invention and which are incorporated herein by reference.

Figure 1:
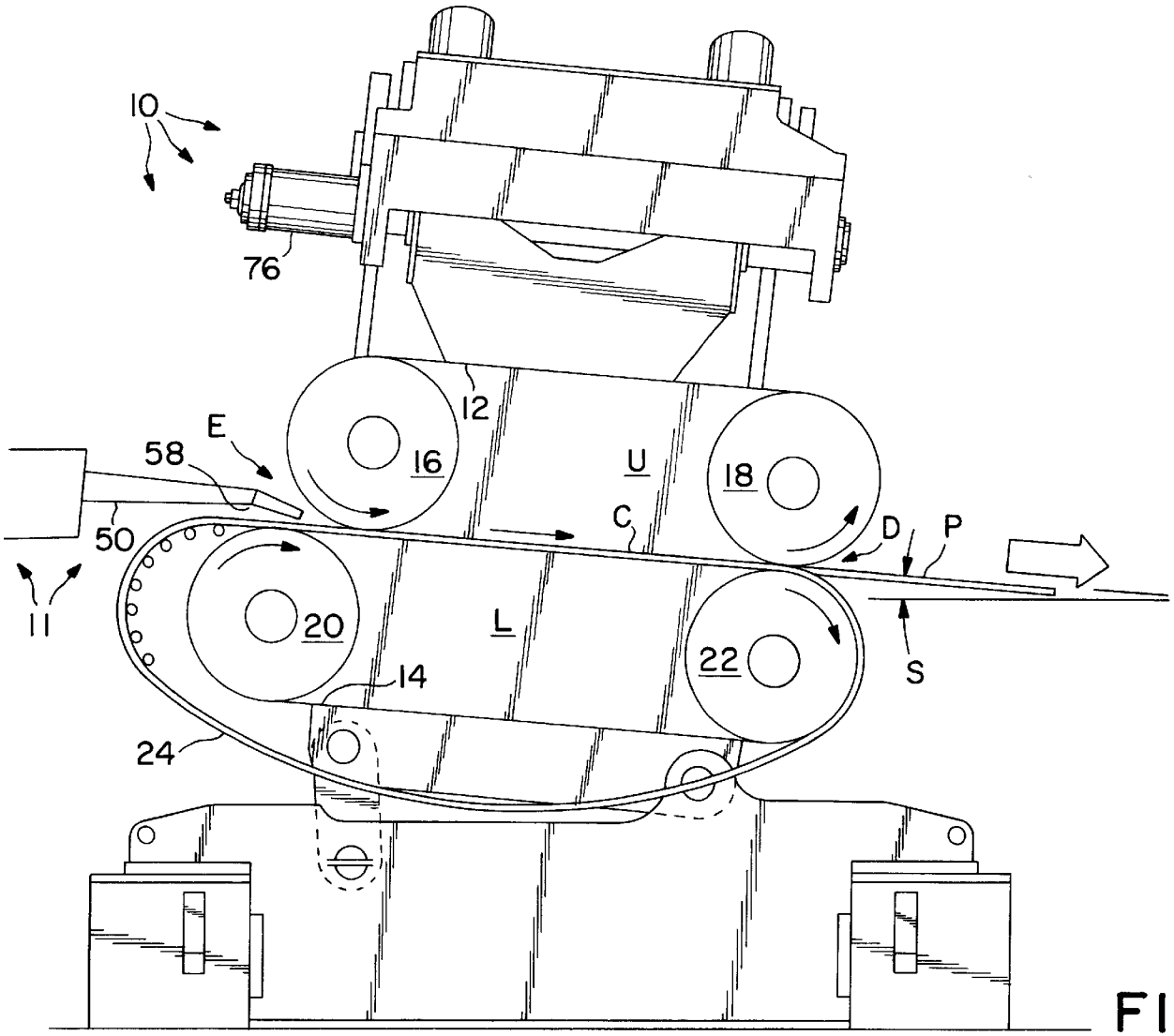
FIG. 1 is an elevation view of a twin-belt continuous casting machine.
Figure 2:
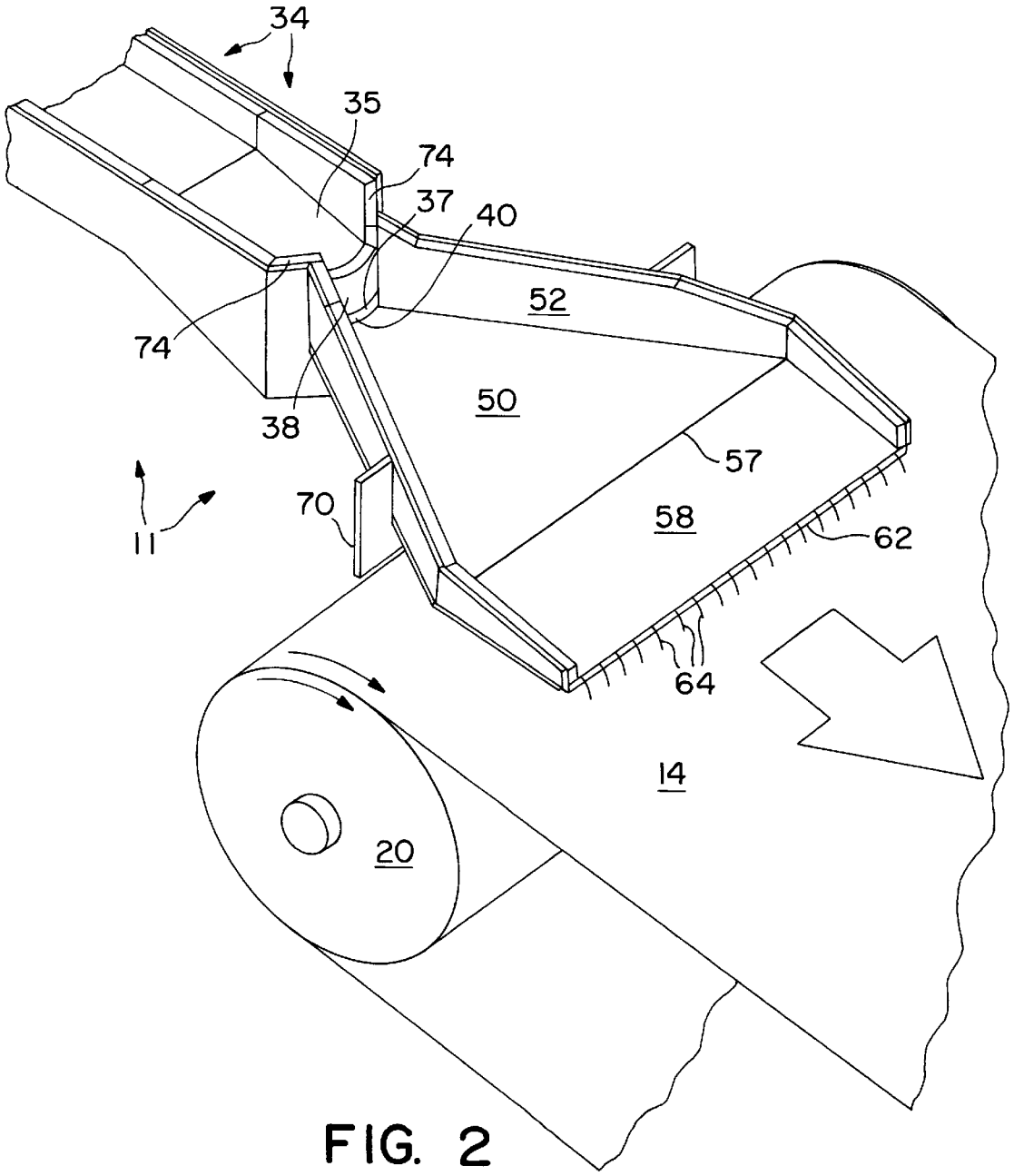
FIG. 2 is a perspective view of the empty distributor of the present invention comprising a skimmer. The view is from above and downstream, and the novel distributor, arcuate weir and diverging apron are shown in relation to the lower carriage and lower belt of a twin-belt metal-casting machine.
Figure 3:
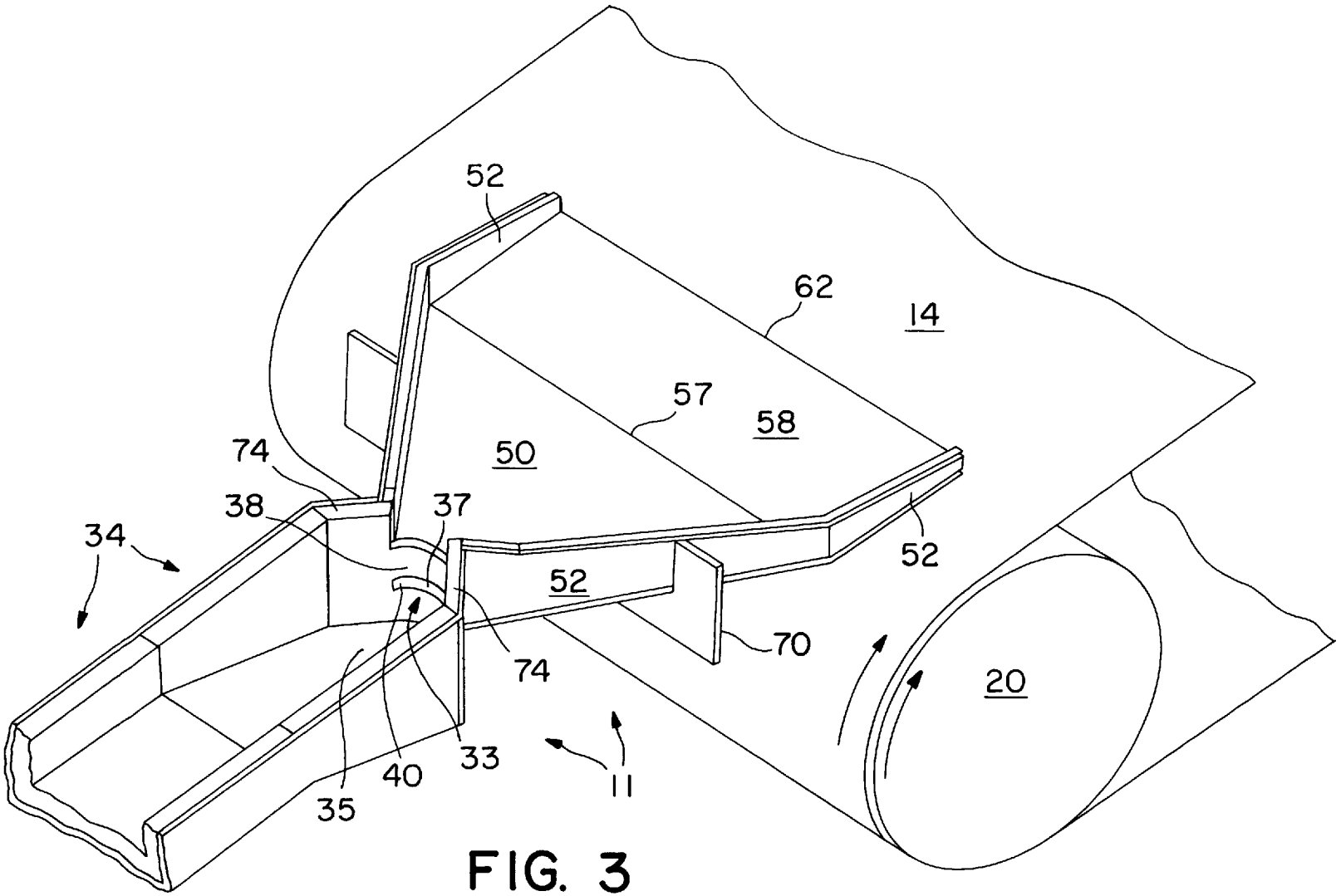
FIG. 3 depicts the apparatus of FIG. 2 but as viewed from above and upstream.

Briefly, the continuous casting machine 10 co-operates with distributor apparatus 11 embodying the present invention. A supply of molten metal M (FIGS. 4, 5, 6, 7 and 8) is fed from a launder 34 for distributing the flowing metal into the upstream or entrance end E of the machine leading into a mold region C formed between upper casting belt 12 and lower casting belt 14. These belts are mounted around upper carriage U and lower carriage L respectively and are revolved in oval paths around the upstream and downstream pulley drums 16 and 18, respectively, of the upper carriage U, and around upstream and downstream pulley drums 20 and 22 respectively, of the lower carriage L. A pair of edge dams 24 (only one is seen in FIG. 1) contains the molten metal sideways as it freezes, completing the defining of the mold region C in its cross-section. Cast metal product P issues from the downstream or discharge end D of the machine 10. The plane of product P is also denominated spatially as the pass line. The casting angle or slope S in FIG. 1 is the downward slope in the downstream direction that plane P makes with the horizontal.

The most preferred embodiment of the invention of the distributor is shown, at 11 in FIGS. 1 through 6. A supply, a stream of slow-moving molten metal M comes from a launder or runner 34 on the left or upstream side, terminating at a sump 35. At the downstream end of this sump 35 is positioned an arcuate weir 33 shown as a circular arc. As is seen most clearly in FIG. 4, an upstream side 36 of arcuate weir 33 is concave in plan view. The bottom (lowest level) 41 of the sump 35 is shown substantially lower than the horizontal top overflow surface or edge 37 surface of the weir 33. The sump 35 may also extend sideways (laterally) to a width greater than that of the top 37 of the weir 33, as is shown most clearly in FIG. 4.

Molten metal moving downstream from sump 35 then converges upon and flows through a transverse slot or horizontally-extending arcuate orifice 40 above the arcuate weir 33. This orifice constitutes one kind of weir, a slotted weir, the slot length of which is disposed across the flow of molten metal so that the metal passes through it. The bottom of the curved, arcuate slot 40 is shown defined by curved, arcuate weir 33. The top of the curved, arcuate slot 40 is shown defined by a curved, arcuate horizontal skimmer 38, which is positioned above and is aligned with the horizontal weir top 37. The sump 35 is deeper or wider, usually both deeper and wider, than the narrow vertical dimension of the slot 40 in slotted weir 33, in order to bring about a desired substantial increase in speed of molten metal as it passes by the arcuate weir and flows through arcuate slot 40.

As the molten metal M in sump 35 approaches slot 40, the depth of sump 35 and its containment volume cause the molten metal in the sump to move much slower than it will later flow when flowing through slot 40. An important feature of the horizontal slot 40 is the concave shape of its members arcuate weir 33 and arcuate skimmer 38 on their upstream sides or, in another way of putting it, the convex shape of arcuate weir 33 and arcuate skimmer 38 on their downstream sides; together they define between them slot 40.

Figure 4:
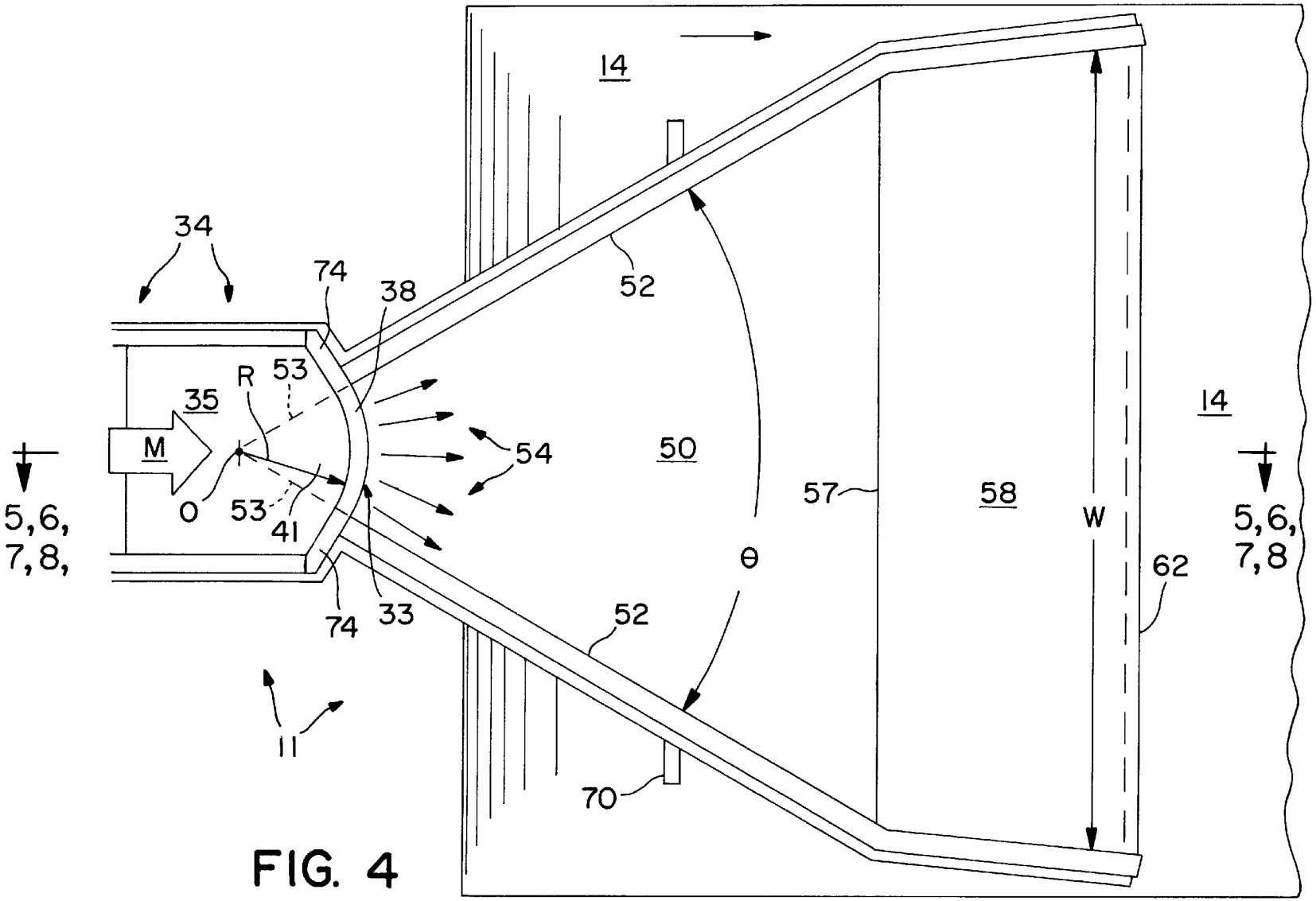
FIG. 4 is a plan view of the distributor with a skimmer, shown in relation to the lower carriage and lower belt of a twin-belt continuous casting machine.
Figure 6:
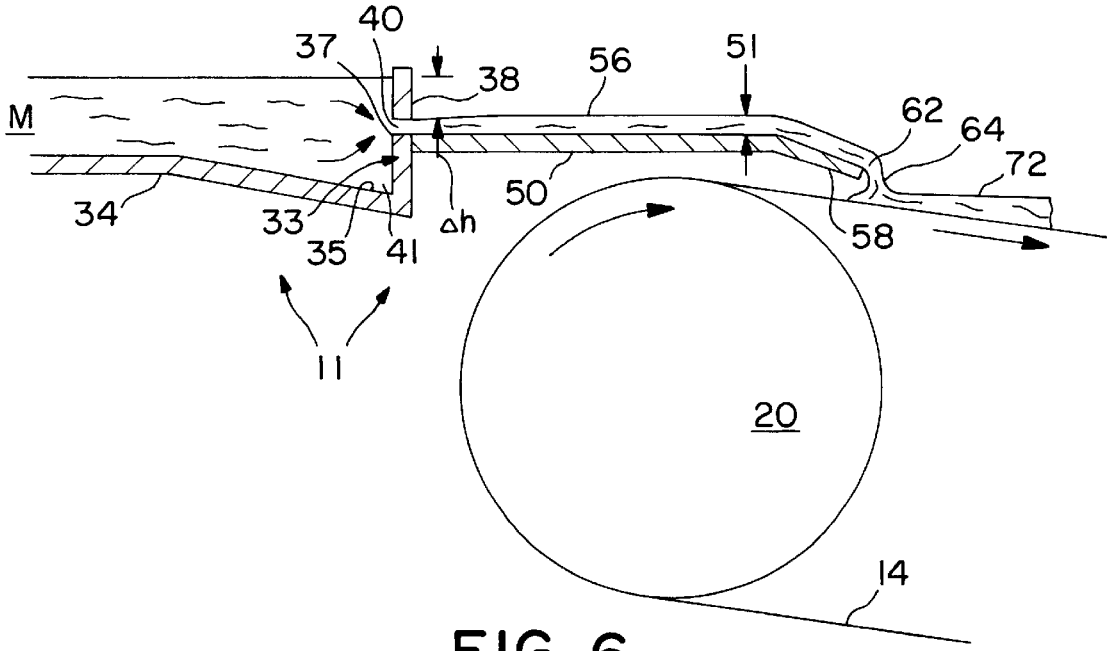
FIG. 6 is like FIG. 5 but with a greater depth of metal in the sump at the left, fed by a launder. This view depicts normal operation.
Figure 7:
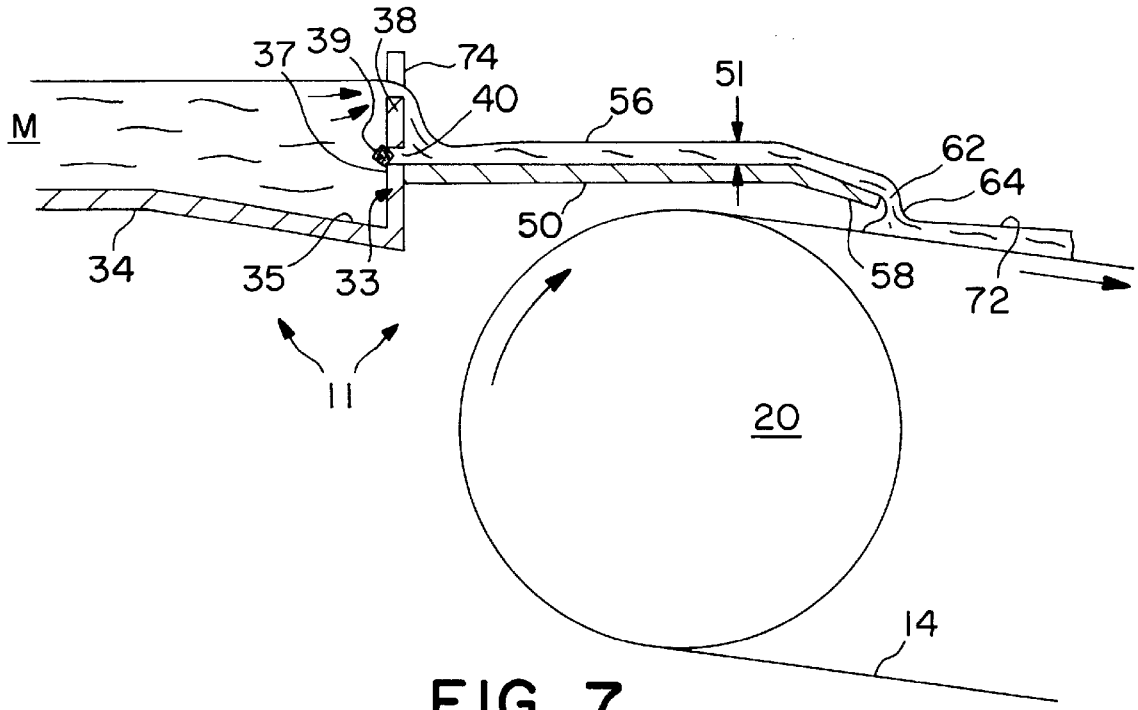
FIG. 7 is like FIG. 6 but with the slot of the weir unintentionally plugged by debris, and so the molten metal is overflowing the skimmer.

If momentary fluctuations (variations) occur in speed or quantity of molten metal flowing through the relatively small cross-sectional flow area of launder (runner) 34, such runner flow-speed variations are absorbed into the relatively large containment volume and large free surface area of sump 35 without allowing any significant fluctuations to occur in the level of molten metal adjacent to the weir 33 (FIG. 8) or adjacent to the weir 33 and skimmer 38 (FIG. 6). In effect, this large containment volume and free surface area of sump 35 relative to the small flow cross-section of runner 34 serves as an isolating chamber interposed between runner 34 and the weir 33 or interposed between runner 34 and the barrier provided by weir 33 plus its associated skimmer 38, thereby keeping the height of molten metal substantially constant adjacent to the weir (FIG. 8) and substantially constant adjacent to the weir plus skimmer (FIG. 6) for maintaining essentially constant the differential head $\Delta h$ and thereby maintaining essentially constant the resultant radial, fan-spread velocity vectors 54 (FIG. 4).

The stated curvature of slot 40 to be described is its arcuate shape as viewed from above. The shown circular-arc curvature of slot 40 has its center at an upstream point 0 (FIG. 4) with a radius R of the circular curvature. In FIG. 4 are two dashed lines 53 which are aligned with side walls 52 and which extend upstream, thereby converging at an angle equal to $\theta$. The meeting point of these lines 53 shows that the upstream center point, 0 for radius R is located at the vertex of the divergence angle $\theta$. An essence of this invention is to bring about a desired radially-directed increase in speed at the arcuate slot 40, i.e., at the top edge 37 of the arcuate weir 33.

Figure 5:
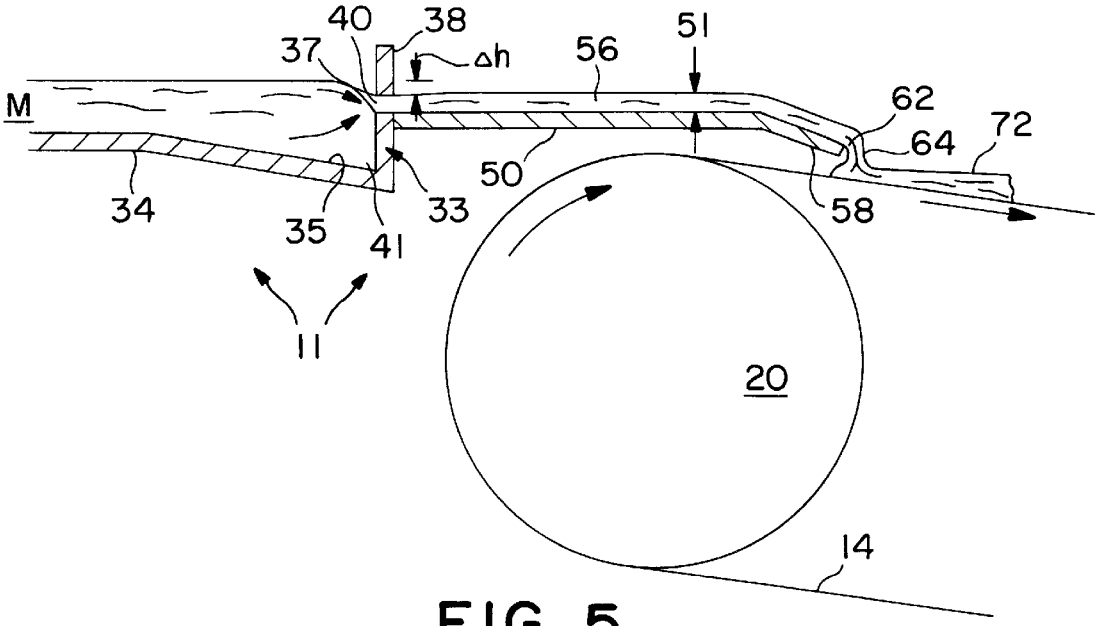
FIG. 5 is a cross-sectioned elevation view of the distributor weir and apron of FIGS. 2, 3 and 4 taken along their centerline 5—5 in FIG. 4. A molten-metal level is shown in FIG. 5 such that the skimmer touches a top surface of the flow but does not restrict the flow. Only details relevant to the flow of molten metal in the plane of the cross-section are noted.

Before explaining three advantageous, simultaneous effects set forth below, it will be helpful to describe similarities between the embodiment shown in FIGS. 1 through 6 (the most preferred embodiment) and the embodiment shown in FIG. 8 (a preferred alternative embodiment). In normal operation (shown in FIG. 6) of the arcuate weir 33 having an arcuate slot 40 (FIGS. 1–6) which is defined by and between the top surface 37 of arcuate weir 33 and the lower surface of the arcuate skimmer 38, it is the size (area) of the opening provided by this slot 40 which restricts and controls the flow. When molten metal level in sump 35 is lower (as shown in FIG. 5), such that the skimmer 38 barely touches or does not touch the molten metal, then the weir 33 no longer operates as a slotted weir, but rather it operates as an overflow weir wherein its substantially horizontal top surface serves as an overflow edge 37 of the weir 33. The embodiment of FIG. 8 has a substantially horizontal overflow top surface (top edge) 37 without a skimmer being positioned above this top surface. Consequently, the embodiment of FIG. 8 always operates as an overflow weir 33 with an overflow top surface 37.

Three simultaneous effects, now to be enumerated as (A), (B), and (C), occur when molten metal converges upon the concave-upstream side of arcuate slot 40, or converges upon concave-upstream side of overflow weir edge 37.

(A) There occurs a drop in the level, i.e., a drop in the potential-energy head. This drop is indicated as differential head Δh as shown, notably in FIGS. 5 and 6, and alternately as shown in FIG. 8.

(B) This differential head Δh reappears as a conversion of potential energy into kinetic energy, that is, as an acceleration, an addition to the speed or velocity head of the flow of molten metal.

(C) The molten metal is impelled downstream from the convex downstream side of orifice 40 or from the convex-downstream side of overflow edge 37 and is dispensed in a diverging radial, fan-shaped flow pattern 56. Corresponding radial velocity vectors of substantially equal length and density point downstream, notably, vectors 54 in FIG. 4. Each velocity vector 54 in the fan-shaped flow pattern 56 points in the direction of the local hydrostatic pressure of the previously approaching, relatively quiet molten metal M at each localized place behind the arcuate weir 33 where that metal went past its arcuate overflow edge 37 and speeded up, that is, speeded up in a direction generally perpendicular to each respective localized place on the arcuate overflow edge 37 of the arcuate weir 33 and then slowed down as it subsequently fanned out in a fanwise flow pattern 56 on an apron 50, forming a thickness 51.

Figure 8:
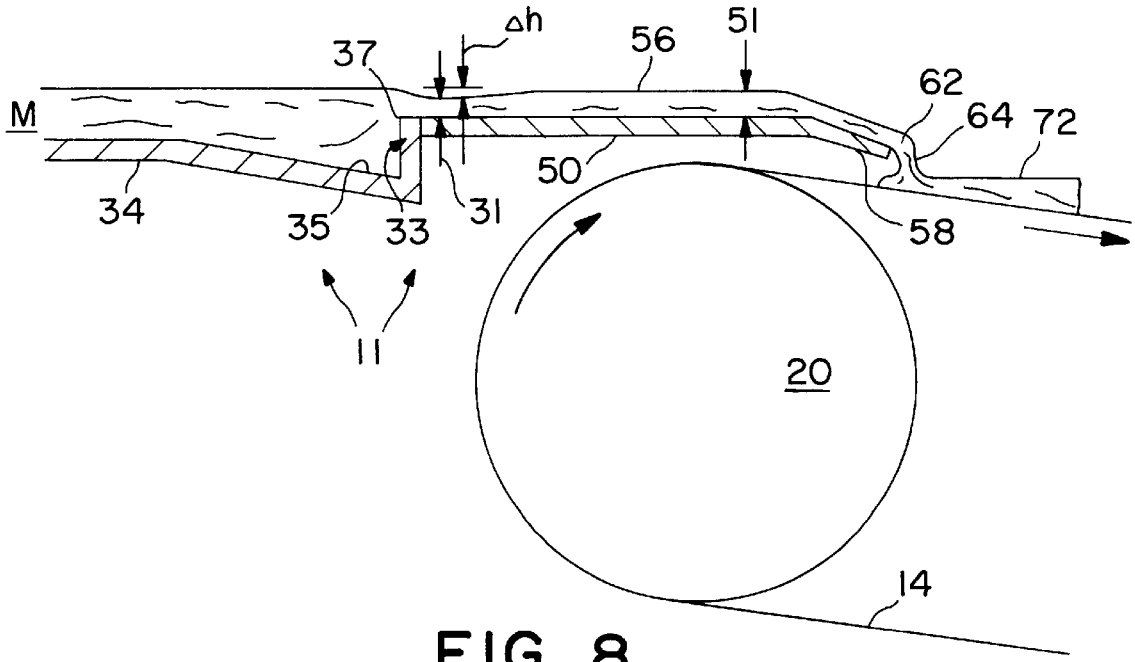
FIG. 8 is a view similar to FIG. 5 but shows an embodiment of the invention without a skimmer.

In thinking about the most preferred embodiment of the invention, one may consider that arcuate slot 40 is substituted where arcuate overflow edge 37 is mentioned in the above paragraphs (A), (B) and (C), because an orifice weir converts into an overflow weir when the level of molten metal is low, as is shown by comparing FIG. 5 with FIGS. 6 and 8. In the most preferred embodiment, the resultant thickness of molten metal flow 56 on the apron 50 is constricted by the narrow vertical dimension of the slot 40 (FIG. 6). In either mode of the invention, the molten metal, after passing through slot 40 and being acted upon by effects (A), (B) and (C), emerges onto a flat, substantially horizontal fan-shaped shelf or apron 50 which is mounted so as to permit slight adjustment of its slope which is shown as horizontal and which works best at about 1 degree of uphill slope. In general, it should not have a significant downward slope but should be adjusted between about 2 degrees upward slope and no slope (i.e., level).

The top surface of apron 50 is shown to be even in height with, i.e., at the same level as, the arcuate overflow weir surface 37, although the top surface of the apron at its upstream end may be placed lower than weir edge 37 in order to create turbulence if turbulence is desired downstream, as may be needed to prevent segregation of certain alloys. A suitable total angle of horizontal, fan-wise divergence θ for obtaining a maximal width W is about 55 degrees, 60 degrees being about the maximum useful angle. The distributor apparatus 11 embodying the invention is useful at angles of divergence θ as low as 15 degrees, if so desired for a particular in-feed of molten metal into a continuous casting machine. The reason for so adjusting the angle of divergence θ is that the change in speed of the flow of metal 56 flowing along the apron 50 is thereby rendered adjustable as is its thickness 51. The width W attained is proportional also to the length of apron 50. W in the embodiment shown of the present invention is usefully as low as about 300 mm (about 12 inches) wide, resulting in a spreading as low as two times the width of slot 40, even though the original motive for tie invention was to cast yet wider sections.

Side walls 52 project above the apron 50 and confine the diverging overflow 56 sideways over the apron. A stiffening beam 70 underneath the apron restricts its thermal distortion.

The molten metal arrives at the end 57 of apron 50 at uniform thickness 51 of flow 56 across its now nearly fully extended width W. The width W as shown on a ramp 58 is about 900 millimeters (about 35½ inches), which is about 6½ times the horizontal width (about 140 mm) of the slot 40 measured straight across. Thus, a uniform fanwise spread 54 of more than six times is advantageously achieved by the arcuate weir 33 with an arcuate slot 40.

In FIG. 1, a downwardly tilted exit ramp 58 is contiguous with end 57 (FIGS. 2 and 3) of apron 50, and this ramp receives the flowing molten metal 56 from the apron 50. Ramp 58 is not an essential part of the invention. However, it is advantageous for conducting molten metal smoothly into twin-belt casting machine of the configuration shown in FIG. 1 in which the metal is to cascade into an open pool 72 (FIGS. 5–8) of metal which lies upon the lower casting belt 14. The distributor apparatus 11 must clear the belt 14 which is moving over the top of the upstream lower pulley drum 18. Hence, the molten metal being so conducted must fall a small distance before it reaches the casting belt. As shown clearly in FIG. 4, the ramp 58 embodies a smaller degree of fanning than the apron 50. The ramp 58 is shown inclined at its maximum preferred usable angle of about 15 degrees downward and allows the flowing molten metal 56 to pick up just enough speed to jump cleanly off of the brink or lip 62 in a uniform cascade 64 (FIGS. 2, 5–8). onto the revolving lower casting belt 14 without any dribbling occurring from the lip 62. The molten metal drops uniformly into the casting apparatus across substantially the full casting width.

As described above, the arcuate slot 40 lies conveniently in a horizontal plane, though variations in shape or orientation are possible for special adjustments of flow. In our preferred use, the sump 35 has a free surface like that of a river; the freedom of its surface provides sump-containment-volume isolation of Δh from effects of momentary fluctuations in flow-speed (momentary fluctuations in momentum) of molten metal entering through runner 34.

In the most preferred embodiment of the invention as shown in FIGS. 1–4 and 6, which may be used for casting a copper slab about 38 mm (about 1½ inch) thick and about 900 mm (about 35½ inches) wide, the width of arcuate slot 40 may be about equal to radius R. For example, R may be about 150 mm (about 5⅞ inches), and the horizontal width of slot 40 as measured straight across may be about 140 mm. The fully fanned-out width W (FIG. 4) of the molten metal 56 downstream beyond a junction line 57 between shelf 50 and ramp 58 is shown, for example, to be about 6½ times the width of the arcuate slot 40 thereby feeding the full width for casting a slab about 900 mm (about 35½ inches) in width. The vertical height of arcuate slot 40 may, for example, be in a range from about 12 percent to about 30 percent of the slot width of 28 mm (about 1⅛ inch). The lowest level 41 (FIG. 6) of sump 35 may, for example as shown, be about 100 mm (about 4 inches) below the lower edge 37 of the slot 40. The total angle θ of divergerce may, for example as approximately shown, be about 55 degrees.

DESCRIPTION OF ALTERNATE PREFERRED EMBODIMENTS

The most preferred embodiment described above has the weir 33 with an arcuate slot 40, which may be described alternatively as a barrier having two elements, namely, a weir 33 with an arcuate overflow weir top edge 37 together with an arcuate skimmer 38.

An alternate embodiment of the invention will now be described with reference to FIG. 8. A supply, a stream of molten metal is shown flowing from a launder or runner 34 into a sump 35, thereby to converge upon and then pass over a weir 33 having an arcuate overflow weir edge 37. As in the earlier-described most preferred embodiment of this invention, the metal as it passes over the arcuate edge 37 is impelled downstream fanwise from the concave-upstream side of arcuate weir top 37 with a freshly acquired impetus due to conversion of potential energy in the differential head Δh into kinetic energy as shown in FIG. 8. The three simultaneous effects (A), (B), and (C) described above still occur. As was explained above, when the height of metal supply from the sump 35 is insufficient to more than touch the lower edge of skimmer 38, as illustrated in FIG. 5, then there is practically no hydrodynamic difference in the performance of the embodiment shown in FIGS. 5 and 6 in comparison with the embodiment shown in FIG. 8.

The most preferred embodiment of this invention is earlier described including use of the arcuate skimmer 38 providing the arcuate slot 40, because it affords a more controlled management of the flow of molten metal. The most preferred embodiment does entail the possibility that debris 39 entrained with the unrefined metal M being cast may more or less plug slot 40. In this event, the metal can overflow the top of the skimmer 38, while cornices 74 prevent any flooding outside of the apparatus 11.

Figure 9:
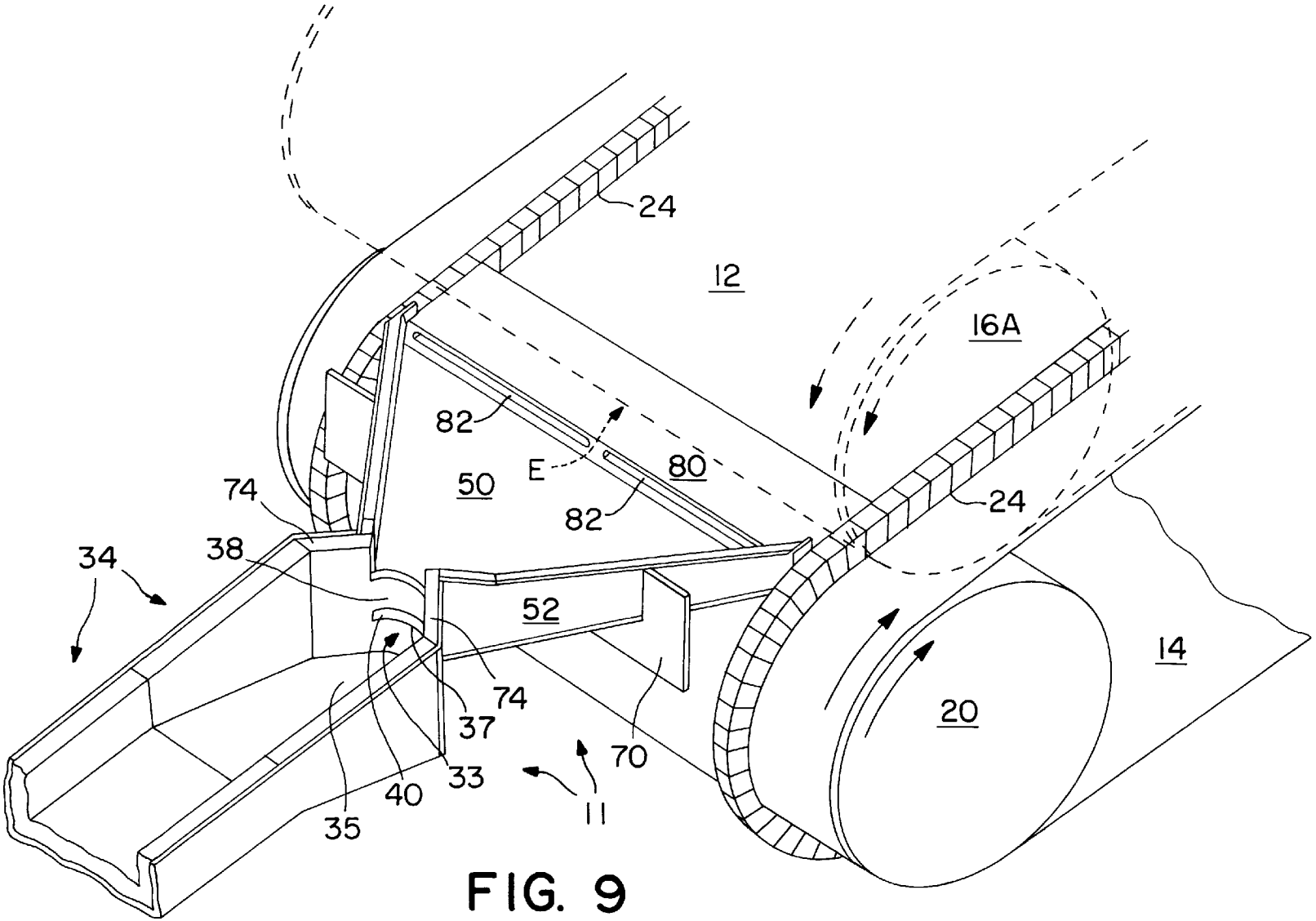
FIG. 9 is a perspective view of an injection-feeding embodiment of the invention as seen from above and upstream. An upper casting belt of a wide twin-belt-type continuous casting machine is shown in dashed outline in FIG. 9.

Another embodiment, an injection embodiment, employs a close-fitting injection nozzle 80 (FIG. 9) for example shown having two wide passageways 82, the nozzle being such as is presently used in the injection casting of aluminum and its alloys in twin-belt casting machines. As illustrated, nozzle 80 replaces the exit ramp 58 of either of the other preferred embodiments. An upper upstream pulley 16A, shown in phantom lines, is placed directly above lower pulley 20. The injection embodiment is useful notably in the casting of exceptionally wide sections to render sufficiently uniform the molten metal temperatures across the width of the molten metal supply at the discharge end of the apron 50.

While the illustrated shape of the aforesaid weir, slot and skimmer is circular, arcuate, the curvature may vary from a circular arc, as may be desired to suit special circumstances. Or the weir, slot and skimmer shape may be a combination of arcuate and straight elements.

It can be envisioned with high probability that the above-described advantages are applicable to the casting of steel, aluminum and aluminum alloy, other shapes of copper, and to castable metals generally. Although the specific, presently preferred embodiments of the invention have been disclosed herein in detail, it is to be understood that these examples of the invention have been described for purposes of illustration. This disclosure is not to be construed as limiting the scope of the invention, since the described methods and apparatus may be changed in details by those skilled in the art of continuous casting of metals, in order to adapt these methods and apparatus to be useful in particular situations, without departing from the scope of the following claims.

I claim:

1. Distributor apparatus for use in distributing a stream of molten metal into a continuous-moving-belt casting machine utilizing at least one wide moving flexible metallic belt as a wide moving mold surface comprising:

a weir for positioning across said stream of molten metal;

said weir being generally concave on its upstream side and convex on its downstream side as viewed from above;

said weir having a generally horizontal overflow surface;

an approximately horizontal apron positioned adjacent to the downstream side of said weir for receiving onto said apron molten metal which has flowed over said overflow surface; and said apron permitting molten metal to spread fanwise to a desired width of flow on said apron suitable for descending from said apron into a continuous-moving-belt machine.

2. Distributor apparatus as claimed in claim 1, wherein:

a sump is positioned upstream of said concave upstream side of said weir;

said sump has a bottom level below the level of said overflow surface; and said weir forms at least a portion of a downstream wall of the sump.

3. Distributor apparatus as claimed in claim 1, wherein:

said apron has side walls diverging downstream from said convex downstream side of said weir at an angle θ in a range from about 15 degrees to about 60 degrees.

4. Distributor apparatus as claimed in claim 3, wherein:

said weir has a width; and between downstream ends of said side walls a lateral width W is about two to about six-and-a-half times the width of said weir.

5. Distributor apparatus as claimed in claim 1, wherein:

said upstream side of said weir has a generally circular concave arcuate shape as viewed from above;

said circular concave arcuate shape has a radius R; and the width of the weir is substantially equal to but less than the length of said radius R.

6. Distributor apparatus as claimed in claim 1, in which:

a downstream downwardly inclined ramp is positioned downstream of said apron;

said ramp is contiguous with said apron along a junction extending transversely relative to a downstream direction of metal flow on said apron;

said ramp has a lip extending transversely relative to the downstream direction; and said ramp is inclined downwardly in the downstream direction at an inclination suitable for flowing molten metal to pick up just enough speed for jumping cleanly off from the lip in a cascade substantially uniform across the width of the lip with insignificant dribbling occurring from the lip.

7. Distributor apparatus as claimed in claim 6, in which:

said ramp is inclined downwardly in the downstream direction at an angle of up to about 15 degrees.

8. Distributor apparatus for use in distributing a stream of molten metal into a continuous-moving-belt casting machine utilizing at least one wide moving flexible metallic belt as a wide moving mold surface comprising:

a weir for positioning across said stream of molten metal;

said weir being generally concave on its upstream side as viewed from above;

said weir having a generally horizontal overflow surface;

a skimmer positioned above said weir;

said skimmer being generally concave on its upstream side as viewed from above;

said skimmer being placed above said weir in substantially uniformly spaced relationship above said overflow surface and forming thereby a slot between said overflow surface and said skimmer for controlling the passage of molten metal through said slot;

said distributor further comprising:

an approximately horizontal apron positioned downstream of and adjacent to said weir for receiving onto said apron molten metal which has flowed through said slot; and said apron permitting molten metal to spread fanwise to a desired width of flow on said apron suitable for descending from said apron into a continuous-moving-belt machine.

9. Distributor apparatus as claimed in claim 8, in which:

said apron has two side walls diverging downstream at an angle θ in a range from about 15 degrees to about 60 degrees.

10. Distributor apparatus as claimed in claim 8, in which:

said upstream side of said skimmer has a generally circular concave shape as viewed from above;

said circular concave arcuate shape has a radius R;

said radius R has a center point O; and said center point O is located near an intersection between two imaginary lines aligned with said two side walls and extended upstream from said two side walls.

11. Distributor apparatus as claimed in claim 1, in which:

said apron has an upward slope in the downstream direction.

12. Distributor apparatus as claimed in claim 11, in which:

said upward slope is in a range of up to about 2 degrees.

13. The method of feeding a stream of molten metal into a wide continuous-moving-belt machine for the continuous casting of a wide metal product, wherein the machine utilizes at least one wide, moving flexible metallic belt as a wide moving mold surface, the method comprising the steps of:

placing across said stream of molten metal a weir the upstream side of which is generally concave and the downstream side of which is generally convex as viewed from above;

converging said stream into a flow of molten metal flowing over said weir, thereby causing:

decreasing height Δh and increasing speed of said molten metal flowing over said weir, while at the same time:

directing said increasing speed of said overflowing metal fanwise from said generally convex downstream side of the weir onto an approximately horizontal apron, followed by the step of:

allowing said fanwise-directed molten metal to spread out fanwise on said apron, followed by the final step of:

flowing said fanwise-spread molten metal into said continuous casting machine for the continuous casting of the wide metal product.

14. The method of feeding a stream of molten metal into a wide continuous-moving-belt machine for the continuous casting of a wide metal product, wherein the machine utilizes at least one wide, moving flexible metallic belt as a wide, moving mold surface, the method comprising the steps of:

flowing said stream of molten metal through a sump having a bottom;

forming at least a portion of a downstream wall of the sump by a barrier having therein a horizontally-oriented slot positioned at an elevation above the bottom of the sump and below the level of a top surface of molten metal in the sump;

forming the upstream side of the slot generally concave as viewed from above;

flowing molten metal from the sump through said slot, thereby providing a differential head Δh for molten metal flowing through said slot for increasing the speed of the molten metal flowing through the slot, while at the same time:

directing said molten metal flowing through the slot fanwise from said slot onto an approximately horizontal apron;

allowing said fanwise-directed molten metal to spread out fanwise on said apron, with the final step of:

flowing said fanwise-spread molten metal into said continuous casting machine for the continuous casting of the wide metal product.

15. The method of pouring molten metal continuously into a wide continuous metal-casting machine, the method comprising the following steps:

shaping a weir at least partially into an arc that is generally concave on its upstream side and convex on its downstream side as seen from above, followed by the steps of:

providing a differential head Δh for molten metal traversing the weir for accelerating a flow of molten metal fanwise as it traverses said weir;

allowing the accelerated fanwise flow of molten metal to diverge fanwise and decelerate after traversing said weir; and feeding the fanwise diverged flow of molten metal into a wide continuous metal-casting machine for producing a continuously cast wide metal product.

16. The method of feeding a stream of molten metal into a wide continuous metal-casting machine, the method comprising the steps of:

passing said molten metal through a launder and into a sump having a greater depth than the launder, thence:

passing said molten metal over a weir top that is at least partially an arc that is generally convex on its downstream side when viewed from above, and which weir top is substantially higher than the bottom of said sump, thereby:

diverging fanwise said flow of molten metal from said convex downstream side, followed by the final step of:

allowing said fanwise-diverged flow of molten metal to flow into a wide continuous metal-casting machine.

17. The method of feeding a stream of molten metal into a wide continuous metal-casting machine, the method comprising the steps of:

passing said stream of molten metal into a sump, followed by the step of:

converging said stream of molten metal into a horizontally-disposed slot that is at least partially an arc bulging downstream when viewed from above, thereby:

diverging fanwise said flow of molten metal, followed by the final step of:

allowing said fanwise-diverged flow of molten metal to flow into a continuous metal-casting machine.

18. Distributor apparatus for use in distributing a stream of molten metal into a continuous-moving-belt casting machine utilizing at least one wide moving flexible metallic belt as a wide moving mold surface comprising:

a weir for positioning across said stream of molten metal;

said weir being generally concave on its upstream side as viewed from above;

said weir having a generally horizontal overflow surface;

a sump positioned upstream of said upstream side of said weir;

said sump having a bottom level below the level of said overflow surface;

said weir forming at least a portion of a downstream wall of the sump;

said sump being wider than a width of said weir;

said downstream wall of the sump having lateral portions extending laterally from the weir;

cornices on said lateral portions of said downstream wall of the sump projecting above the level of said overflow surface of the weir;

said distributor further comprising:

an approximately horizontal apron positioned downstream of and adjacent to said weir for receiving onto said apron molten metal which has flowed over said overflow surface; and said apron permitting molten metal to spread fanwise to a desired width of flow on said apron suitable for descending from said apron into a continuous-moving-belt machine.

19. Distributor apparatus as claimed in claim 8, wherein:

a sump is positioned upstream of said upstream side of said weir;

said sump has a bottom level below the level of said slot; and said weir together with said skimmer form at least a portion of a downstream wall of the sump.

20. Distributor apparatus as claimed in claim 19, wherein:

said sump is wider than a width of said weir and skimmer;

said downstream wall of the sump has lateral portions extending laterally from the weir and skimmer; and cornices on said lateral portions of said downstream wall of the sump project above the level of the top of said skimmer.

21. Distributor apparatus for use in distributing a stream of molten metal into a continuous-moving-belt casting machine utilizing at least one wide moving flexible metallic belt as a wide moving mold surface comprising:

a weir for positioning across said stream of molten metal;

said weir being generally concave on its upstream side as viewed from above;

said weir having a generally horizontal overflow surface;

a skimmer positioned above said weir;

said skimmer being generally concave on its upstream side as viewed from above;

said skimmer being placed above said weir in substantially uniformly spaced relationship above said overflow surface and forming thereby a slot between said overflow surface and said skimmer for controlling the passage of molten metal through said slot;

said upstream side of said weir and said upstream side of said skimmer have generally circular concave arcuate shape as viewed from above;

said circular concave arcuate shape has a radius R;

said slot has a horizontal width substantially equal to the length of said radius R;

said distributor further comprising:

an approximately horizontal apron positioned downstream of and adjacent to said weir for receiving onto said apron molten metal which has flowed over said overflow surface; and said apron permitting molten metal to spread fanwise to a desired width of flow on said apron suitable for descending from said apron into a continuous-moving-belt machine.

22. Distributor apparatus for use in distributing a stream of molten metal into a continuous-moving-belt casting machine utilizing at least one wide moving flexible metallic belt as a wide moving mold surface comprising:

a weir for positioning across said stream of molten metal;

said weir being generally concave on its upstream side as viewed from above;

said weir having a generally horizontal overflow surface;

a skimmer positioned above said weir;

said skimmer being generally concave on its upstream side as viewed from above;

said skimmer being placed above said weir in substantially uniformly spaced relationship above said overflow surface and forming thereby a slot between said overflow surface and said skimmer for controlling the passage of molten metal through said slot;

said slot has a horizontal width;

a vertical height of said slot is in a range from about 12 percent to about 30 percent of the horizontal width of the slot;

said distributor further comprising:

an approximately horizontal apron positioned downstream of and adjacent to said weir for receiving onto said apron molten metal which has flowed over said overflow surface; and said apron permitting molten metal to spread fanwise to a desired width of flow on said apron suitable for descending from said apron into a continuous-moving-belt machine.

* * * * *